US005776017A

United States Patent [19]

Brawn

[11] Patent Number: 5,776,017

[45] Date of Patent: Jul. 7, 1998

[54] BATTING PRACTICE DEVICE

[76] Inventor: Randy W. Brawn, 327 13th St., Huntington Beach, Calif. 92648

[21] Appl. No.: 629,932

[22] Filed: Apr. 12, 1996

[51] Int. Cl.[6] ..... A63B 69/40

[52] U.S. Cl. ..... 473/426

[58] Field of Search ..... 473/426, 428, 473/434

[56] References Cited

U.S. PATENT DOCUMENTS

| | | | |
|---|---|---|---|
| 884,387 | 4/1908 | Hettinger | 273/335 |
| 2,089,652 | 2/1937 | Kelly | 273/97 |
| 3,011,784 | 12/1961 | Segretto | 273/26 |
| 3,589,726 | 6/1971 | Crowder | 273/98 |
| 4,010,950 | 3/1977 | Visockis | 273/26 E |
| 4,050,694 | 9/1977 | Domroski | 273/26 E |
| 4,138,107 | 2/1979 | Janis | 473/426 |
| 4,322,075 | 3/1982 | Hynes | 273/26 E |
| 4,735,413 | 4/1988 | Yamanouchi | 473/426 |
| 4,966,367 | 10/1990 | Oyarzaha | 473/426 |
| 5,040,791 | 8/1991 | Ratajac | 473/426 |
| 5,072,937 | 12/1991 | Zarate | 473/426 |
| 5,419,550 | 5/1995 | Blom | 473/426 |
| 5,458,326 | 10/1995 | Marcyes | 473/426 |

FOREIGN PATENT DOCUMENTS

| | | |
|---|---|---|
| 1220749 | 5/1960 | France . |
| 320933 | 10/1929 | United Kingdom . |

*Primary Examiner*—Theatrice Brown
*Attorney, Agent, or Firm*—Dennis W. Beach

[57] ABSTRACT

The batting practice device has a structure of a vertical member with a suspension beam attached to suspend a ball and a cross beam and leg beam to support the vertical member. An elastic cord is attached to the vertical member and routed through a corner pulley and an eyebolt to be attached to a ball line. The ball line is routed through one or more pulleys to suspend a ball from the suspension beam. The bottom attachment end of the ball line is attached to two anchor lines of which one is then attached to the cross beam right end and the other to the cross beam left end. The device may include a rotating cross beam to allow ease of storage. A beam pin is also provided to adjust the height of the ball above the ground.

8 Claims, 2 Drawing Sheets

BATTING PRACTICE DEVICE

BACKGROUND OP THE INVENTION

1. FIELD OF THE INVENTION

This invention relates to devices used to practice hitting a ball. The new device provides a means to position a ball to be hit, to monitor the flight of the ball when hit, and to return the displaced ball to be hit again.

2. DESCRIPTION OF RELATED ART

There are currently in use various devices for batting practice or hitting a baseball. These apparatus usually involve a tether or line attached to the ball which line is then anchored or attached to a fixed position pole or other device. The teaching of such devices includes positioning the ball to be hit by the batter and the restraint of the ball such that it does not travel in the direction hit. The restraint normally causes the struck ball to rotate or pivot about a shaft once put in motion. In cases where two lines are used for restraint, the ball is forced in the vector director caused by the attachment of the lines to a fixed point support. These devices require stabilizing the ball by the user if repeated rapid hitting is required. Also the direction of flight of the ball is greatly distorted by the action of the lines or tether.

Other devices are used in the practice of hitting or kicking a ball or in games using balls which involve a line or tether to restrain the ball. While some of these devices do not restrain the direction of flight of the ball once momentum is imparted to it, they do not provide a feature to rapidly return the ball to a position to be hit or impacted again as is useful in practice and coaching situations.

The present invention provides a method to place a ball in position to be hit by for example by use of a baseball bat, to allow the ball once hit to travel a short distance in the general direction in which motion was imparted, and then to rapidly return the ball to a position to be hit again. This provides an environment in which a user may repeatedly hit the ball for purposes of practicing their swing and hitting technique while allowing a coach to observe the result and provide guidance. The device may have structural provisions for ease of storage when not in use.

SUMMARY OF THE INVENTION

A primary objective of the present invention is to provide a means to suspend a ball in a position to be hit by a user of the device and to restrain the ball once hit to a limited area of travel. Another object is to allow the struck ball to generally travel in the direction in which momentum is imparted for a short distance. A further object is to rapidly return the ball to the suspended position such that it may be struck repeatedly. Another object is to provide for ease of storage of the device when not in use.

In accordance with the description presented herein, other objectives of this invention will become apparent when the description and drawings are reviewed.

DESCRIPTION OF THE PREFERRED EMBODIMENT

The batting practice device consists of a support structure such as tubular elements to which an elastic cord is attached and routed by eyebolts and pulleys to a ball line. The ball line is attached to the support structure and routed by pulleys to suspend an attached ball in position to be hit by the user. The ball line is also attached to a pair of anchor lines which are attached to the bottom cross beam of the support structure. When the suspended ball is struck, the elastic cord and pulley system with ball line allow the ball to travel in the general direction in which hit. When the force of the elastic cord slows the ball or the elastic cord pulley is stopped by the suspension beam pulley, the moving ball and attached lines wrap around the support structure. The elastic force of the elastic cord causes the lines to unwrap from the structure and return the ball to a position to be hit again.

Figure 1:
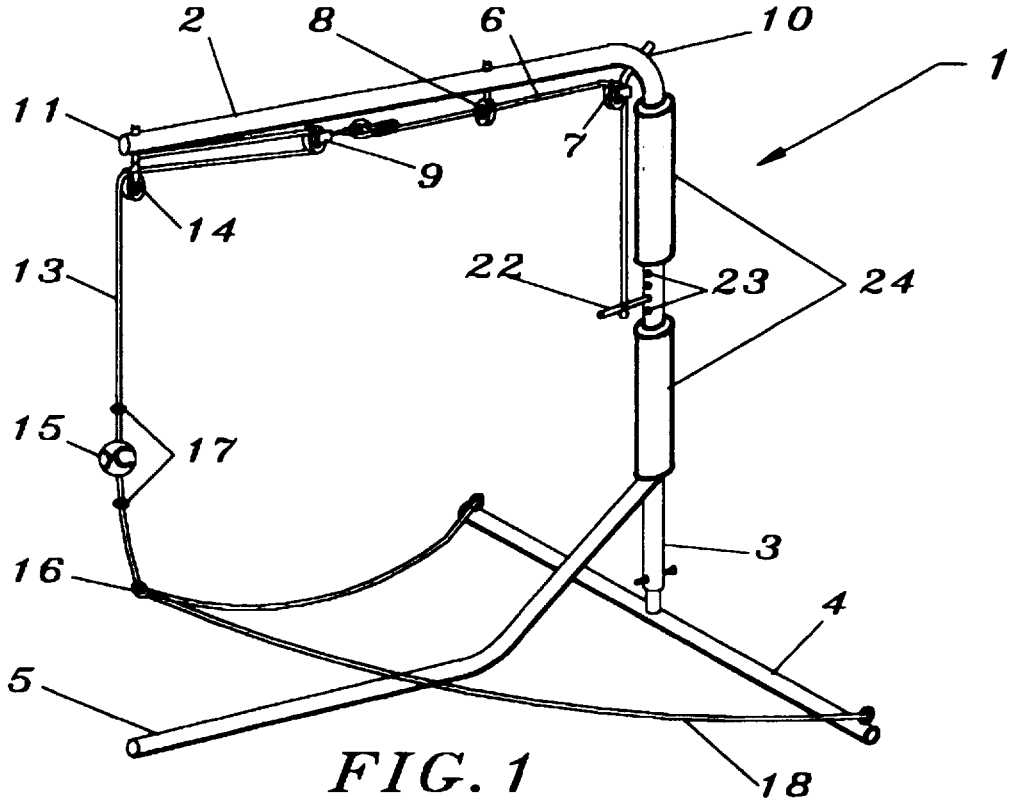
FIG. 1 illustrates a perspective view of the batting practice device.
Figure 2:
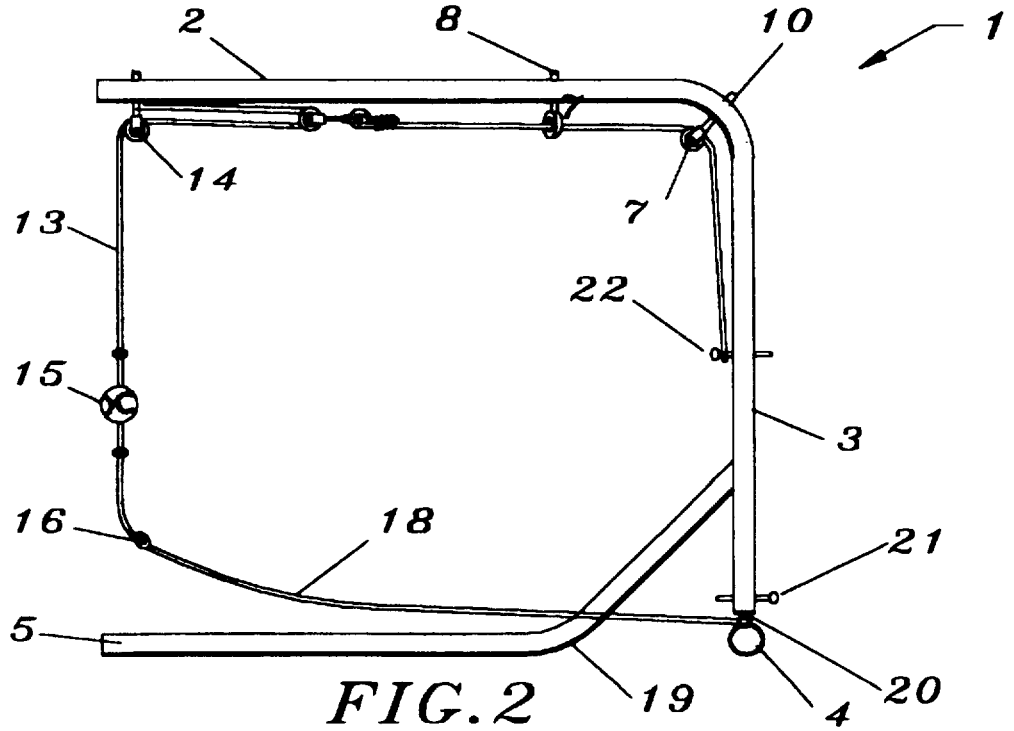
FIG. 2 illustrates a side elevation view of the batting practice device.
Figure 3:
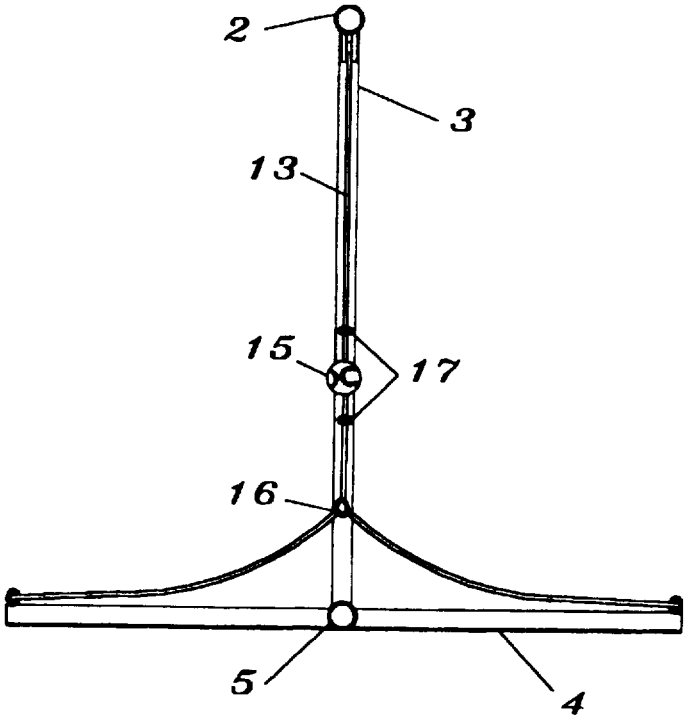
FIG. 3 illustrates a front view of the batting practice device.
Figure 4:
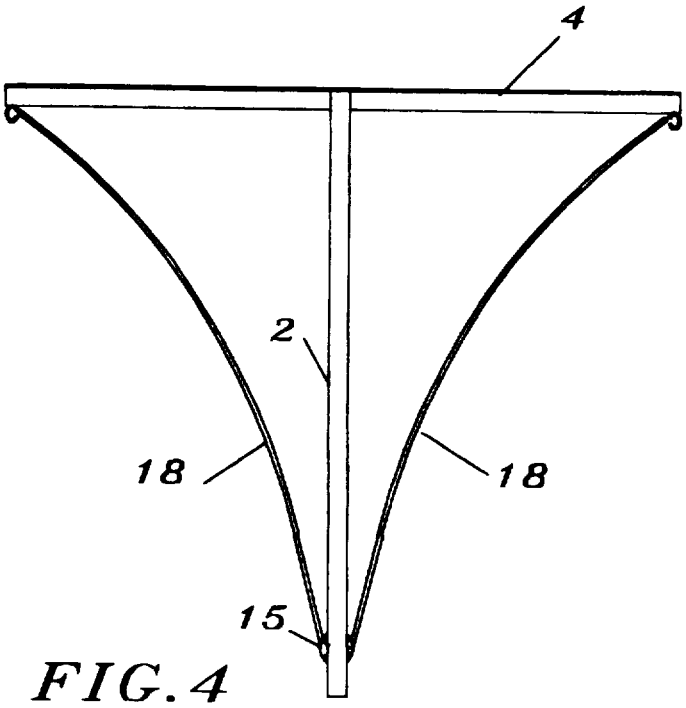
FIG. 4 illustrates a top view of the batting practice device.

Referring to FIGS. 1 through 4, the batting practice device (1) has a horizontal suspension beam (2) attached to a vertical member (3) thus forming a top corner (10). The vertical member (3) is supported by attachment to a cross beam (4) and a support beam (5). The cross beam (4) is attached so as to be perpendicular to a plane containing the suspension beam (2) and the vertical member (3).

It has been found that a support structure (2,3,4,5) having a suspension beam (2) of length 56 inches, a vertical member (3) of length 67 inches, a cross beam (4) of length 45 inches and a support beam (5) of 52 inches horizontal footprint provide good dimensions for use by a baseball hitter for batting practice.

An elastic cord (6) is attached at one end to the vertical member (3) and routed through a first pulley (7) and an eyebolt (8) to be attached to a connecting pulley (9) intermediate the top corner (10) and suspension beam free end (11) of the suspension beam (2).

A ball line (13) is attached to the suspension, beam free end (11) and routed through the connecting pulley (9) to a second end pulley (14) attached at the suspension to drop vertically. The beam free ball line (13) has a ball (15) attached intermediate the second pulley (14) and the bottom attachment end (16). The ball line (13) may be threaded through a hole in the ball (15) and the ball (15) retained in place by knotting the ball line (13) or use of clamp (17) attached above and below the ball (15) on the ball line (13).

Two anchor lines (18) are attached to the bottom attachment end (16). One anchor line (18) is attached to the cross beam (4) on the right end and one anchor line (18) is attached to the cross beam (4) on the left end.

It has been found that an elastic cord (6) of length 76 inches in the relaxed condition and 5/16 inches diameter attached at approximately 29 to 37 inches from the corner end (10) to the vertical member (3) works well. A ball line (13) of length 100 inches provides the proper length to suspend the ball (15) and attach to the anchor lines (18) which should be 61 inches in length. A nylon rope of ¼ inch diameter has been found adequate for the ball line (13) and anchor lines (18). By experiment these lengths and attachment points have been found to provide proper positioning and travel of the ball (15) and rapid return of the ball (15) to the hitting position.

By experiment, it has been found that an elastic cord which positions the connecting pulley (9) approximately 23 inches from the suspension beam free end (11) provides a good travel distance for the ball (15) when hit before the connecting pulley (9) strikes the second pulley (14) to restrain the ball's (15) flight. The eyebolt (8) was located 39 inches from the suspension beam free end (11).

An alternate method uses an elastic cord (6) attached directly to the ball line (13). The elastic cord (6) must be of proper length and elasticity to allow travel of the ball (15) and return to be hit.

An adjustment pin (22) may be used with appropriately placed apertures (23) to allow raising and lowering of the ball (15). By experiment useful positions for apertures (23) on the vertical member (3) have been found to be 29, 31½, 34 and 36 ½ inches from the corner end (10).

The support beam (5) as illustrated in the Drawing has a 30 degree from horizontal angular member (19) for added strength and to allow for rotating the cross beam (4) for flat storage. An illustrated in FIG. 2, the vertical member (3) may have a rotatable vertical shaft (20) slidably mounted in the vertical member (3) and retained by a beam pin (21). When the batting practice device (1) is to be stored, the pin (21) is removed and the cross beam (4) is rotated 90 degrees. This presents a flat single plane structure which is more easily stored.

The vertical member (3) is covered with a 1 inch foam pad sleeve (24) covered with nylon cloth to cushion the impact of the ball (15) on the structure.

An alternate means of supporting the support structure (12) is to replace the suspension beam (2) with a building rafter (not shown). In this embodiment the vertical member (3) is attached at the top corner (10) to a rafter (not shown). The rafter (not shown) then serves the function of the suspension beam (2) as described. The vertical member (3) may be attached by means of a hinge which allows the support structure (12) to be rotated up against the building ceiling for storage.

I claim:

1. A batting practice device comprising:

a substantially horizontal suspension beam having one end attached to the upper end of a vertical member to define a top corner, said suspension beam further having a free end;

a cross beam attached to a lower end of said vertical member and being perpendicular to a plane defined by the suspension beam and the vertical member;

a horizontal support beam having one end attached to the vertical member intermediate said vertical member upper and lower ends, said support beam being in the same plane and parallel to said suspension beam;

an elastic cord having one end attached to the vertical member intermediate said top corner and the cross member, said elastic cord having its other end routed through a first pulley attached at said top corner and through an eyebolt attached to said suspension beam intermediate said top corner and said suspension beam free end and attached to a connecting pulley;

a ball line having one end connected to the suspension beam free end and routed through said connecting pulley and a second pulley attached to said suspension beam free end;

a ball slidably mounted on said ball line below said second pulley, said ball being retained at a vertical position on the ball line by retention means; and a pair of anchor lines, each anchor line having an end thereof attached to respectively an end of said cross beam and the other end thereof attached to the other end of said ball line.

2. The device as in claim 1 wherein the means for retention is a pair of knots in the ball line, each being on opposite sides of said ball.

3. The device as in claim 1 wherein the means for retention is a pair of clamps on the ball line.

4. The device as in claim 1 wherein said support beam has an angled portion attached to the vertical member.

5. The device as in claim 1 wherein the vertical member is rotatably and slidably mounted on a vertical shaft, said vertical shaft being retained in said vertical member by a pin, said cross beam being attached to the vertical shaft.

6. The device as in claim 1 wherein the vertical member has a plurality of vertically spaced apertures intermediate said top corner and said cross beam, said elastic cord being attached to said vertical member by an adjustment pin, said adjustment pin being insertable in said apertures.

7. The device as in claim 1 wherein there is a pad sleeve circumferentially mounted on the vertical member intermediate the corner end and the cross beam.

8. A batting practice device comprising:

a substantially horizontal suspension beam having one end attached to the upper end of a vertical member to define a top corner, said suspension beam further having a free end;

a cross beam attached to a lower end of said vertical member and being perpendicular to a plane defined by the suspension beam and the vertical member;

a horizontal support beam having one end attached to the vertical member intermediate said vertical member upper and lower ends, said support beam being in the same plane and parallel to said suspension beam;

an elastic cord having one end attached to the vertical member intermediate said top corner and the cross member, said elastic cord having its other end routed through a first pulley attached at said top corner and through an eyebolt attached to said suspension beam intermediate said top corner and said suspension beam free end and attached to a ball line;

said ball line routed through a pulley mounted at said suspension beam free end;

said ball slidably mounted on said ball line below said pulley, said ball being retained at a position on said ball line by retention means; and a pair of anchor lines, each anchor line having one end thereof attached to respectively an end of said cross beam and its other end thereof attached to the other end of said ball line.

* * * * *